US007658645B1

(12) United States Patent
Morello et al.

(10) Patent No.: US 7,658,645 B1
(45) Date of Patent: Feb. 9, 2010

(54) ELECTRICAL CONNECTOR

(75) Inventors: John R. Morello, Warren, OH (US); James M. Rainey, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/228,352

(22) Filed: Aug. 12, 2008

(51) Int. Cl.
*H01R 13/40* (2006.01)

(52) U.S. Cl. ..... 439/595; 439/752.5

(58) Field of Classification Search ..... 439/595, 439/744, 752, 752.5
See application file for complete search history.

(56) References Cited

U.S. PATENT DOCUMENTS 5,839,925 A * 11/1998 Simmons ..... 439/852
5,980,318 A * 11/1999 Morello et al. ..... 439/595
6,068,524 A * 5/2000 Koumatsu ..... 439/752.5
6,159,047 A * 12/2000 Tanaka ..... 439/595
7,048,584 B1 5/2006 Morello et al.
7,179,136 B1 2/2007 Morello
7,232,339 B1 * 6/2007 Wilson et al. ..... 439/595
7,384,309 B1 6/2008 Morello et al.
7,396,255 B2 7/2008 Morello et al.

* cited by examiner

*Primary Examiner*—Thanh-Tam T Le
(74) *Attorney, Agent, or Firm*—Thomas N. Twomey

(57) ABSTRACT

An electrical connector includes a terminal and a connector body. The terminal has a recess and has one or more tabs. The connector body has a cavity that is constructed and sized to receive the terminal. The connector body has a nib protruding into the cavity, and has one or more rails protruding into the cavity. When the terminal is received in the cavity, the nib mates with the recess and the tab bears against the rail.

10 Claims, 3 Drawing Sheets

ELECTRICAL CONNECTOR

FIELD OF THE INVENTION

This invention relates generally to electrical connectors, and more particularly to electrical connectors having terminals that are received in cavities of connector bodies.

BACKGROUND OF THE INVENTION

Electrical connectors are often used for joining electrical circuits, wires, and/or devices to one another or to other electrical components. In one type, a plurality of terminals is joined to a single connector body which defines an equal number of cavities as the number of terminals so that a single terminal can be received in a single cavity. Once received, the terminals may be secured in place, requiring a tool for removal.

SUMMARY OF THE INVENTION

One embodiment of the invention may include an electrical connector that itself may include a terminal and a connector body. The terminal has a recess and has one or more tabs that protrude away from a side of the terminal. The connector body has a cavity that is constructed and sized to receive the terminal. The connector body has a nib that protrudes into the cavity and has one or more rails that protrude into the cavity. When the terminal is received and secured in the cavity, the nib mates with the recess to help prevent the terminal from being inadvertently withdrawn out of the cavity, and the tabs bear against the rails to help keep the nib and the recess mated.

One embodiment of the invention may include an electrical connector which itself may include a female terminal and a connector body. The female terminal has a leading end and a recess. The female terminal also has a first tab that protrudes from the leading end, and has a second tab that protrudes from the leading end. The connector body has a cavity that is constructed and sized to receive the female terminal. The connector body has a nib that protrudes into the cavity, has a first rail that protrudes into the cavity, and has a second rail that protrudes into the cavity. When the female terminal is being inserted in the cavity and before it is secured therein, the leading end moves in a generally forward axial direction and the first tab passes a radial side of the first rail and the second tab passes a radial side of the second rail. The leading end also moves in a generally rearward axial direction until the nib mates with the recess, and in which the first tab bears against an opposite radial side of the first rail and in which the second tab bears against an opposite radial side of the second rail.

DETAILED DESCRIPTION OF THE PREFERRED EMBODIMENTS

Referring in more detail to the drawings, the figures show an exemplary embodiment of an electrical connector 10 that includes a female terminal 12 and a connector body 14. The electrical connector 10 can be used in a number of applications that join electrical circuits, wires, devices, or other electrical components, including automotive applications. The electrical connector 10 has a simple design and construction that permits use of, among other materials, a 30% glass-fiber reinforced polybutylene terephthalate plastic (PBT 30GF) as the material for the connector body 14, while maintaining a sufficient interlock between the female terminal 12 and the connector body 14 during use.

Figure 1:
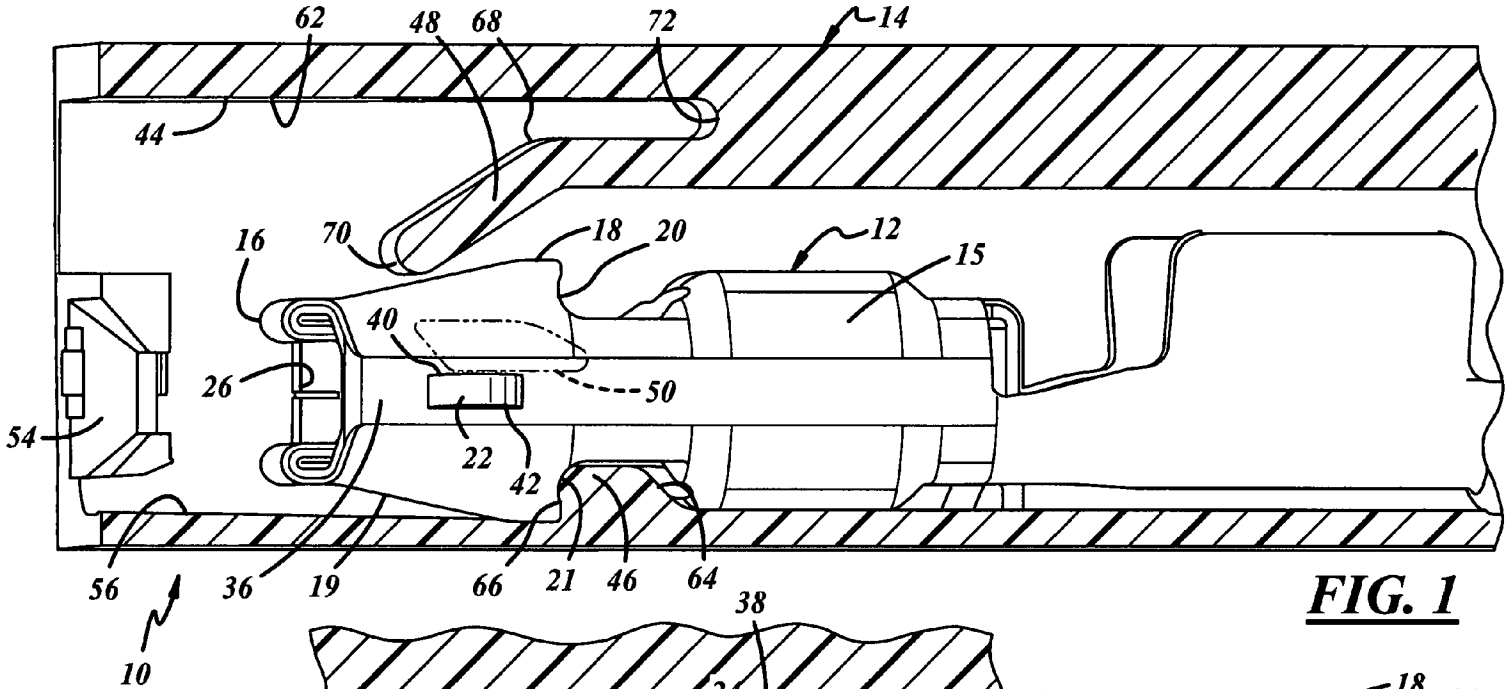
FIG. 1 is fragmented side view of an exemplary embodiment of an electrical connector with a female terminal received in a cavity of a connector body.
Figure 2:
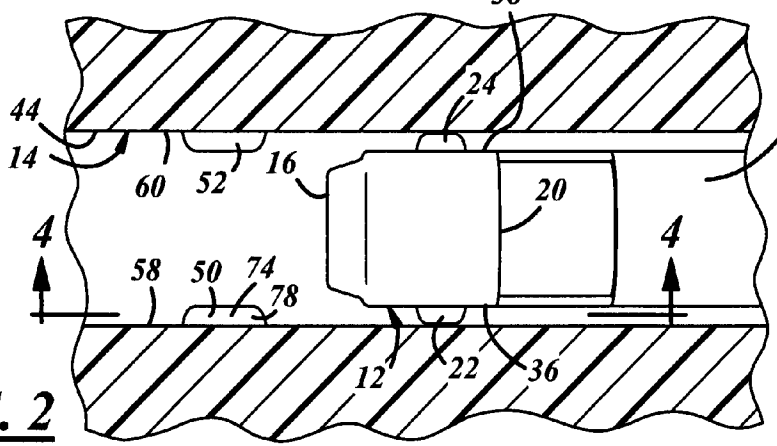
FIG. 2 is a top view of the electrical connector of FIG. 1.
Figure 3:
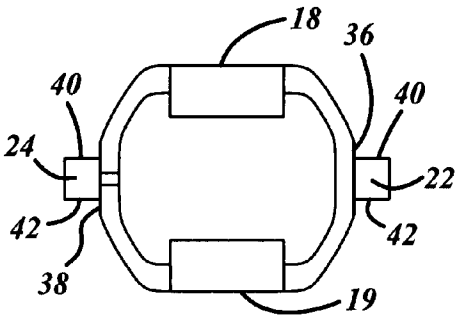
FIG. 3 is a front view of the female terminal of FIG. 1.

The female terminal 12 is constructed to receive a male terminal blade (not shown) at one end, and to be attached to one or more wires (not shown) at an opposite end. Referring to FIGS. 1-3, the female terminal 12 has an elongated hollow body portion 15 that is generally cylindrical. The female terminal 12 may include, among other components, a leading end 16, a first sloped surface 18, a second sloped surface 19, a first recess 20, a second recess 21, a first tab 22, and a second tab 24. The leading end 16 is inserted first into the connector body 14 and has an opening 26 that first accepts the male terminal blade. The first and second sloped surfaces 18 and 19 are located at the leading end 16 and are outwardly slanted from the opening 26 and toward the recesses 20, 21. In cross-section, the first and second sloped surfaces 18 and 19 may have a semi-circular shape.

Either the first recess 20 or the second recess 21 mates with a complementary structure of the connector body 14 depending on insertion orientation to help keep the female terminal 12 secured in place when the male terminal blade is being inserted into the female terminal and when subjected to pulling forces from the one or more wires during use. The recesses 20 and 21 can come in various shapes and sizes, including a depressed surface in the body portion 15. The recesses 20 and 21 can also have openings that lead to the hollowed-out interior of the body portion 15. The first recess 20 is located next to the first sloped surface 18, and the second recess 21 is located next to the second sloped surface 19.

The first and second tabs 22 and 24 are used to help position the female terminal 12 in the connector body 14 during insertion, and are used to help keep the female terminal secured in place once the female terminal is completely received in the connector body. The first and second tabs 22 and 24 can come in various shapes and sizes. Referring to FIGS. 1-3, the first and second tabs 22 and 24 are generally rectangular projections protruding away from the body portion 15 in a radial direction with respect to the body portion. The first and second tabs 22 and 24 are located on opposite sides of the body portion 15 with respect to each other, and are respectively located on a first planar surface 36 and a second planar surface 38. Each of the first and second tabs 22 and 24 has a top surface 40 and a bottom surface 42. In other embodiments, the first and second tabs may have a semi-circular shape, a v-shape, or another shape that projects away from the body portion 15. Still in other embodiments, there may be only a single tab, or there may be more than two tabs.

The connector body 14 can be designed to receive a single female terminal or a number of female terminals. Referring to FIGS. 1 and 2, the connector body 14 helps temporarily secure the female terminal 12 in place so that the female terminal can receive the male terminal blade without inadvertently dislodging from the connector body. The connector body 14 may include, among other components, a cavity 44, a nib 46, a resilient tongue 48, a first rail 50, and a second rail 52. The cavity 44 defines an elongated space and extends from one open end in which a female terminal 12 is inserted, and to another open end 54 into which the male terminal blade is inserted. In the case in which the connector body 14 is designed to receive more than one female terminal 12, the connector body can have an equal number of cavities as there are female terminals, and the cavities can be arranged one-on-top of the other and/or side-by-side to form an electrical connector assembly. The cavity 44 can be rectangular and can be bounded by a floor 56, a first side wall 58, a second side wall 60, and a ceiling 62. In other embodiments, the cavity 44 may have a cylindrical shape.

The nib 46 mates with one of the first and second recesses 20 and 21 of the female terminal 12 to help keep the female terminal secured in place when the male terminal blade is being inserted into the female terminal and when subjected to pulling forces from the one or more wires during use. In FIG. 1, the nib 46 is received in the second recess 21. The nib 46 can come in various shapes and sizes to, among other things, complement the various shapes and sizes of the recesses. Referring to FIG. 1, the nib 46 protrudes from the floor 56 and into the cavity 44. The nib 46 is rigid in the sense that it does not substantially flex or bend, and is one-piece with the connector body 14. The nib 46 has a ramped surface 64 and a shoulder surface 66.

The resilient tongue 48 helps position the first and second tabs 22 and 24 with respect to the first and second rails 50 and 52 when the female terminal 12 is being inserted into the cavity 44, and helps hold-down and keep the female terminal secured in place once the female terminal is completely received in the cavity. During insertion, the resilient tongue 48 flexes slightly toward the ceiling 62 and then returns to its unflexed position in which the resilient tongue biases the female terminal 12 toward the floor 56. Referring to FIG. 1, the resilient tongue 48 is a finger-like projection that extends from the ceiling 62 and protrudes into the cavity 44 toward the floor 56. The resilient tongue 48 has a bend 68 about midway in its body and terminates at a free end 70. A space 72 is formed between the resilient tongue 48 and the ceiling 62.

The first and second rails 50 and 52 bear against the first and second tabs 22 and 24 and are used to help hold-down and keep the female terminal 12 secured in place once the female terminal is completely received in the cavity 44. The first and second rails 50 and 52 can come in various shapes and sizes. Referring to FIG. 3, in side cross-section, the first and second rails 50 and 52 each have a parallelogram shape. The first rail 50 protrudes away from the first side wall 58 and into the cavity 44, and the second rail 52 protrudes away from the second side wall 60 and into the cavity. The first and second rails 50 and 52 are rigid in the sense that they do not substantially bend or flex, and are one-piece with the connector body 14. The first and second rails 50 and 52 are located at opposite positions with respect to each other. Each of the first and second rails 50 and 52 has a top surface or first radial side 74 (only the first rail 50 shown), and a bottom surface or second radial side 76. A first ramped surface 78 is formed on a forward end on each of the first and second rails 50 and 52; and a second ramped surface 80 is formed on a rearward end on each of the first and second rails. In other embodiments, there may be only a single rail, or there may be more than two rails.

Figure 4:
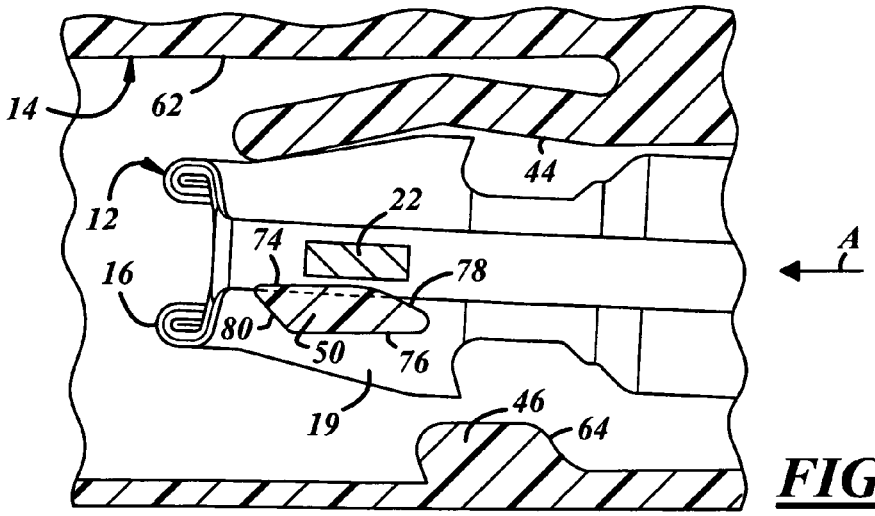
FIG. 4 is a fragmented side view taken along line 4-4 of FIG. 2, showing the female terminal in one position as it is being inserted in the cavity.
Figure 5:
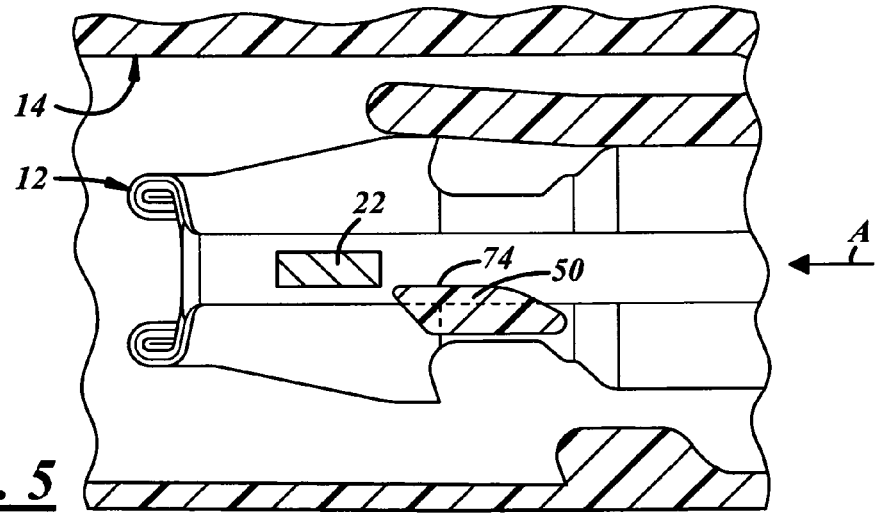
FIG. 5 is a fragmented side view similar to that of FIG. 4, showing the female terminal in another position as it is being inserted in the cavity.

In use, the female terminal 12 can be temporarily secured-in-place in the connector body 14 by a push-pull movement. Referring to FIG. 4, the female terminal 12 is inserted in the cavity 44 and pushed, or advanced, in a forward axial direction A. The second sloped surface 19 rides up against the ramped surface 64 of the nib 46 which causes the leading end 16 to move in the upward radial direction and toward the ceiling 62. The first tab 22 can ride against the first ramped surface 78 of the first rail 50 and the second tab 24 can ride against the first ramped surface of the second rail 52. This brings the first and second tabs 22 and 24 radially above the first and second rails 50 and 52 as shown. Referring to FIG. 5, upon further advancement in the forward axial direction A, the first and second tabs 22 and 24 move past the respective first radial sides (first radial side 74 shown) of the first and second rails 50 and 52.

Figure 6:
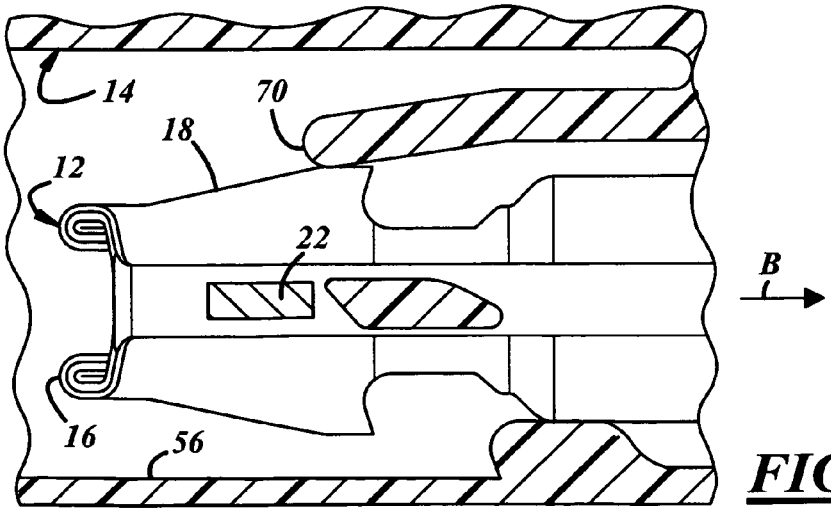
FIG. 6 is a fragmented side view similar to that of FIG. 4, showing the female terminal in another position as it is being inserted in the cavity.
Figure 7:
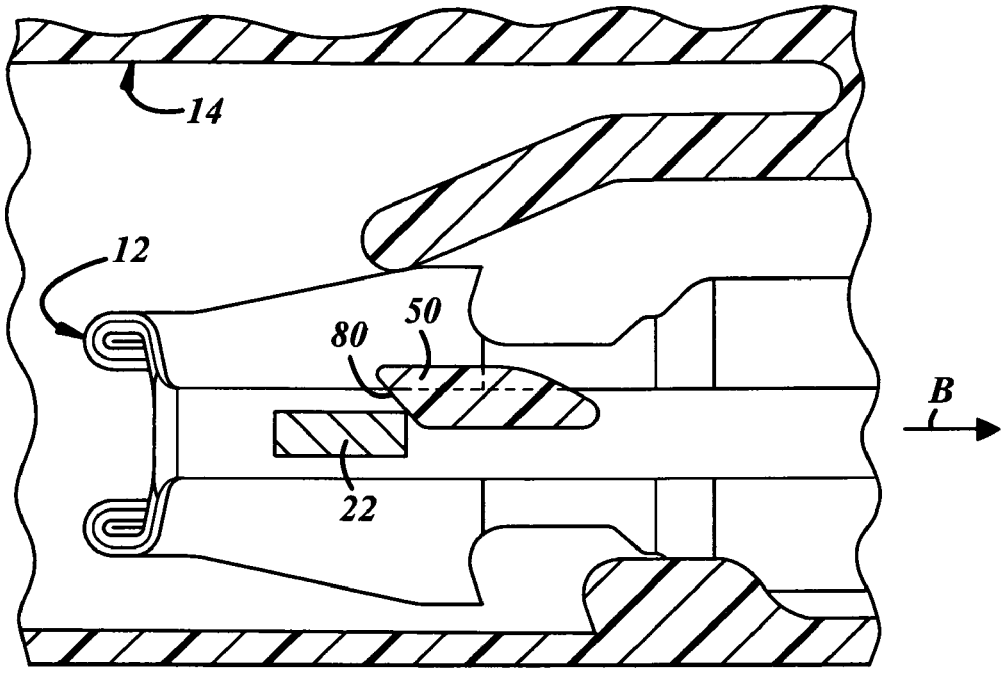
FIG. 7 is a fragmented side view similar to that of FIG. 4, showing the female terminal in another position as it is being inserted in the cavity.
Figure 8:
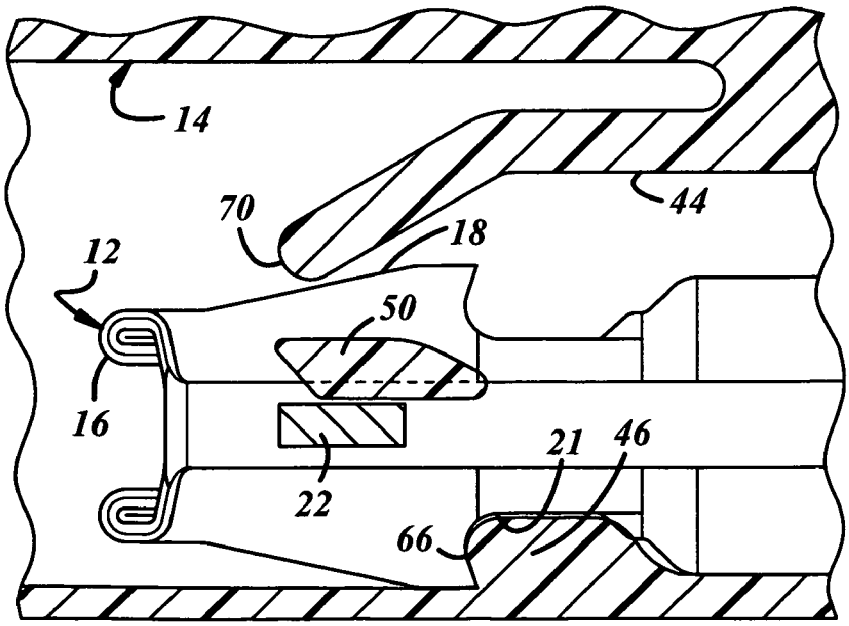
FIG. 8 is a fragmented side view similar to that of FIG. 4, showing the female terminal in a final position in the cavity.

Referring to FIG. 6, during this movement, the free end 70 comes into contact with the first sloped surface 18 and causes the leading end 16 to move in the downward radial direction and toward the floor 56. The female terminal 12 can then be pulled or reversed in a rearward axial direction B. Referring to FIG. 7, the first tab 22 can ride against the second ramped surface 80 of the first rail 50, and the second tab 24 can ride against the second ramped surface of the second rail 52. Referring to FIG. 8, this brings the first and second tabs 22 and 24 radially below the first and second rails 50 and 52. The female terminal 12 is continued in the rearward axial direction B until the second recess 21 mates with the nib 46. In this final position, the shoulder surface 66 abuts against the second recess 21, and the first and second tabs 22 and 24 respectively bear against the first and second rail 50 and 52. The first and second tabs 22 and 24 are thus captured beneath the first and second rails 50 and 52 which prevents the leading end 16 from moving in the upward radial direction, helps keep the nib 46 and the second recess 21 mated, and ultimately helps prevent the female terminal 12 from being dislodged and unexpectedly withdrawn out of the cavity 44. In this position too, the free end 70 can remain in contact with the first sloped surface 18 which also can help prevent the female terminal 12 from being dislodged and unexpectedly withdrawn out of the cavity 44.

Though the electrical connector is described as including a female terminal, it could instead include a male terminal with similar structure and functionality as described for the female terminal. For instance, the male terminal could have the various recesses and tabs that interact with the nib and rails.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical connector comprising:

a terminal having a recess, having at least one tab protruding from a side of the terminal; and a connector body having a cavity constructed to receive the terminal, having a nib protruding into the cavity, having at least one rail protruding into the cavity, wherein when the terminal is received in the cavity, the nib mates with the recess to help prevent the terminal from being withdrawn out of the cavity, and the at least one tab bears against the at least one rail to help keep the nib and the recess mated; wherein the terminal has a sloped surface and the connector body has a resilient tongue extending into the cavity and terminating at a free end, the free end contacting the sloped surface when the terminal is being inserted in the cavity to help position the at least one tab with respect to the at least one rail.

2. The electrical connector of claim 1 wherein the at least one tab includes a first tab protruding from one side of the terminal and includes a second tab protruding from an opposite side of the terminal, wherein the at least one rail includes a first rail protruding into the cavity and includes a second rail protruding into the cavity at a position that is opposite the first rail, and wherein when the terminal is received in the cavity, the first and second tabs respectively bear against the first and second rails to help keep the nib and recess mated.

3. The electrical connector of claim 1 wherein the at least one tab has a top surface and the at least one rail has a bottom surface, the top and bottom surfaces respectively bearing against each other when the nib and the recess are mated thus preventing the terminal from being rotated within the cavity.

4. The electrical connector of claim 1 wherein the at least one rail has a ramped surface on a forward end that contacts the at least one tab when the terminal is being inserted in the cavity to help position the at least one tab with respect to the at least one rail.

5. The electrical connector of claim 1 wherein the at least one rail has a ramped surface at a rearward end that contacts the at least one tab when the terminal is being inserted in the cavity to help position the at least one tab with respect to the at least one rail.

6. The electrical connector of claim 1 wherein the mated nib and recess prevent the terminal from being moved in a rearward axial direction within the cavity, and the at least one tab and the at least one rail bearing against one another prevent the terminal from being rotated within the cavity.

7. An electrical connector comprising:

a female terminal having a leading end and a recess, having a first tab protruding from the leading end, and having a second tab protruding from the leading end; and a connector body having a cavity constructed to receive the female terminal, having a nib protruding into the cavity, and having a first rail protruding into the cavity and a second rail protruding into the cavity, wherein when the female terminal is being inserted in the cavity, the leading end moves in a generally forward axial direction and the first and second tabs move past a respective radial side of the first and second rails, and the leading end moves in a generally rearward axial direction until the nib mates with the recess and in which the first and second tabs bear against a respective opposite radial side of the first and second rails; wherein the leading end has a sloped surface and the connector body has a resilient tongue extending into the cavity and terminating at a free end, the free end contacting the sloped surface when the female terminal is being inserted in the cavity to help position the first and second tabs with respect to the first and second rails when the leading end is moving in the generally rearward axial direction.

8. The electrical connector of claim 7 wherein the mated nib and recess prevent the leading end from being moved further in the rearward axial direction within the cavity, and the first and second tabs and the first and second rails respectively bearing against one another prevent the leading end from being rotated within the cavity.

9. The electrical connector of claim 8 wherein each of the first and second rails has a ramped surface on a forward end that respectively contact the first and second tab when the female terminal is being inserted in the cavity to help position the first and second tabs with respect to the first and second rails when the leading end is moving in the generally forward axial direction.

10. The electrical connector of claim 9 wherein each of the first and second rails has a ramped surface at a rearward end that respectively contact the first and second tab when the female terminal is being inserted in the cavity to help position the first and second tabs with respect to the first and second rails when the leading end is moving in the generally rearward axial direction.

* * * * *